US007559425B2

(12) United States Patent
Hsu et al.

(10) Patent No.: US 7,559,425 B2
(45) Date of Patent: Jul. 14, 2009

(54) PACKAGING SYSTEM FOR COMPUTER

(75) Inventors: Hsiang-Lung Hsu, Tu-Cheng (TW); Ji-Dong Xie, Shenzhen (CN); Guan-Dong Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 297 days.

(21) Appl. No.: 11/309,884

(22) Filed: Oct. 17, 2006

(65) Prior Publication Data

US 2008/0087570 A1 Apr. 17, 2008

(51) Int. Cl.
*B65D 71/00* (2006.01)

(52) U.S. Cl. ..... 206/576; 206/320; 206/521; 206/523; 206/592

(58) Field of Classification Search ..... 206/320, 206/523, 521, 576, 499, 591, 592, 593, 588
See application file for complete search history.

(56) References Cited

U.S. PATENT DOCUMENTS 6,554,133 B1 * 4/2003 Kropf et al. ..... 206/320
6,622,860 B2 * 9/2003 Horbal ..... 206/320
6,868,965 B2 * 3/2005 Miller et al. ..... 206/320
6,938,773 B1 9/2005 Sotto
2005/0155890 A1 * 7/2005 Manuel ..... 206/523
2006/0113214 A1 * 6/2006 Shimizu et al. ..... 206/576
2006/0219596 A1 * 10/2006 Lin et al. ..... 206/592

FOREIGN PATENT DOCUMENTS

JP 53135793 A * 11/1978

* cited by examiner

*Primary Examiner*—Luan K Bui
*Assistant Examiner*—Chun Cheung
(74) *Attorney, Agent, or Firm*—Wei Te Chung

(57) ABSTRACT

An all-in-one packaging system is provided for holding a computer and a liquid crystal display (LCD) together. The computer has four standoffs. The LCD includes a screen and a board protruding from a back of the screen. The packaging system includes a pair of opposite first cushions, second cushions, and a carton. Each first cushion defines a window for receiving one end portion of the computer. A recess is defined in a top edge of each first cushion adjacent the window for receiving the screen of the LCD on the computer. The second cushions sits atop the pair of first cushions respectively. Accessory boxes are disposed on the second cushion. Each second cushion includes a bottom surface with a shape configured to fit the back of the LCD. The carton defines a housing for receiving the assembled first and second cushions, computer, LCD and accessory boxes therein.

20 Claims, 4 Drawing Sheets

PACKAGING SYSTEM FOR COMPUTER

FIELD OF THE INVENTION

The present invention relates to packaging system, more particularly to packaging system for shipping computers with accessories thereof.

DESCRIPTION OF RELATED ART

After a computer system is produced, a packaging cushion is usually used for packing and protecting the computer system. Conventionally, a computer and a liquid crystal display (LCD) are respectively packed in separate cushions, and disposed in two different shipping boxes. A computer system is usually shipped to a consumer with many accessories, such as peripherals including a mouse, a keyboard, a battery charger, and a power cord. These peripherals are not connected to the computer but are still shipped with the computer and generally require separate packaging. However, the separate packaging of the computer, the LCD, and the accessories consume a great number of materials and occupy a great amount of space, which adds to the shipment cost of the computer system.

What is needed, therefore, is a packaging system, which allows shipment of the computer, the LCD, and the accessories all in one shipping box.

SUMMARY OF THE INVENTION

An examplary packaging system is provided for holding a computer and a liquid crystal display (LCD) together. The computer has four standoffs. The LCD includes a screen and a board protruding from a back of the screen. The packaging system includes a pair of opposite first cushions, second cushions and a carton. Each first cushion defines a window for receiving one end portion of the computer. A recess is defined in a top edge of each cushion adjacent to the window for receiving the screen of the LCD on the computer. Each second cushion sits atop a corresponding first cushion. Each second cushion includes a bottom surface with a shape configured to fit the back of the screen of the LCD. The carton defines a housing for receiving the assembled first and second cushions, computer, and LCD therein.

Other advantages and novel features will be drawn from the following detailed description of preferred embodiments with attached drawings, in which:

DETAILED DESCRIPTION OF THE INVENTION

Figure 1:
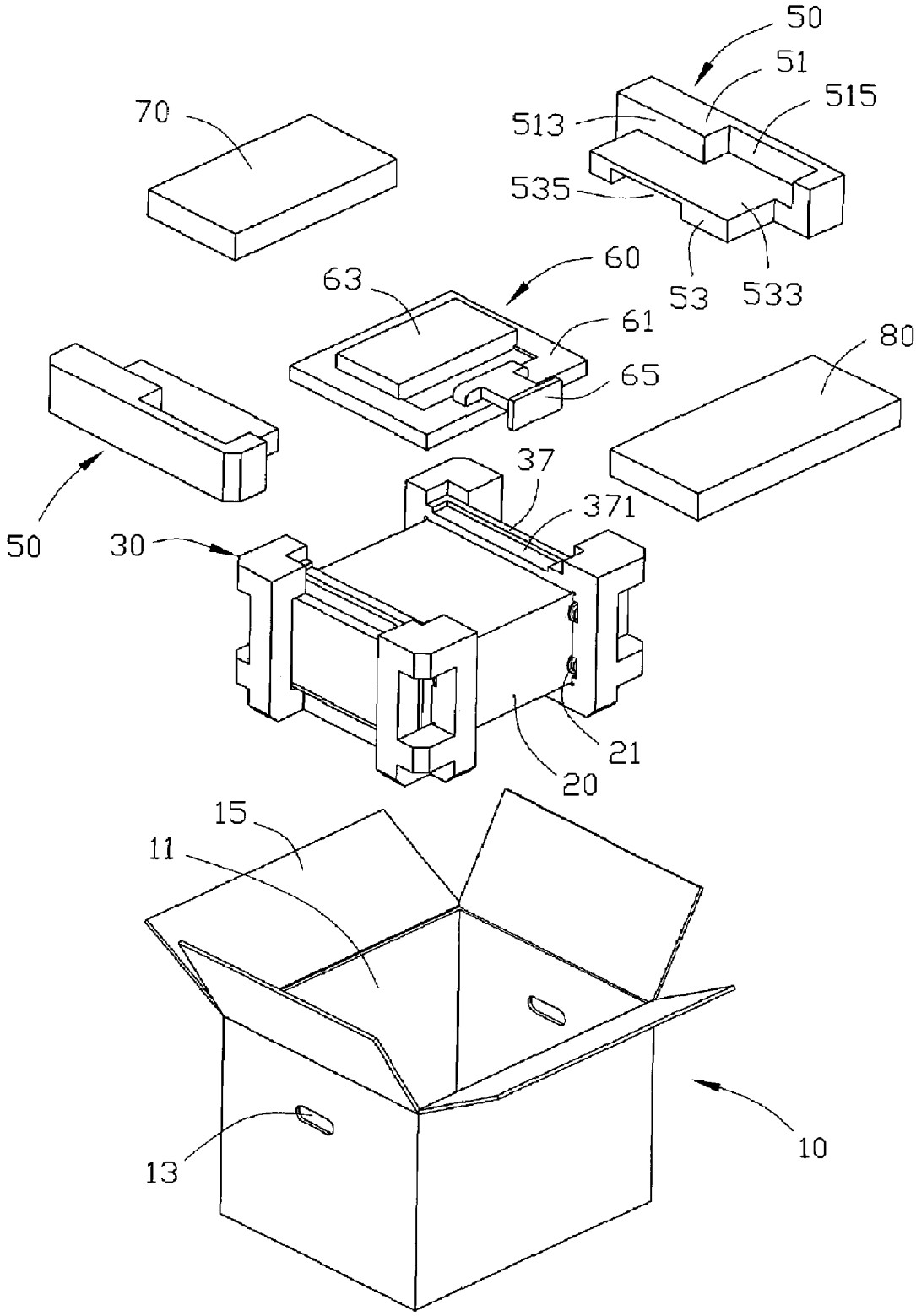
FIG. 1 is an isometric exploded view of computer packaging in accordance with a preferred embodiment of the present invention, including a carton, a pair of first cushions, and a pair of second cushions.

Referring to FIG. 1, an all-in-one packaging system for shipping a computer system in accordance with the present invention includes a shipping carton 10, a pair of first cushions 30 for protecting a computer 20 having four standoffs 21, and a pair of second cushions 50 for protecting a Liquid Crystal Display (LCD) 60 and carrying a first accessory box 70 and a second accessory box 80. The LCD 60 includes a flat display screen 61, a rectangular board 63 protruding from a back of the screen 61, and a seat 65 integrated with the back of the screen 61.

The shipping carton 10 is a parallelepiped-shaped box, including four side walls. A housing 11 is defined by the side walls, for receiving the first cushions 30 and the second cushions 50. A pair of substantially elliptical slots 13 is respectively defined in two opposite side walls for facilitating transport of the shipping carton 10 containing the computer system. Also, the carton 10 includes four flaps 15 that are respectively coupled to the top edges of the four side walls.

Figure 2:
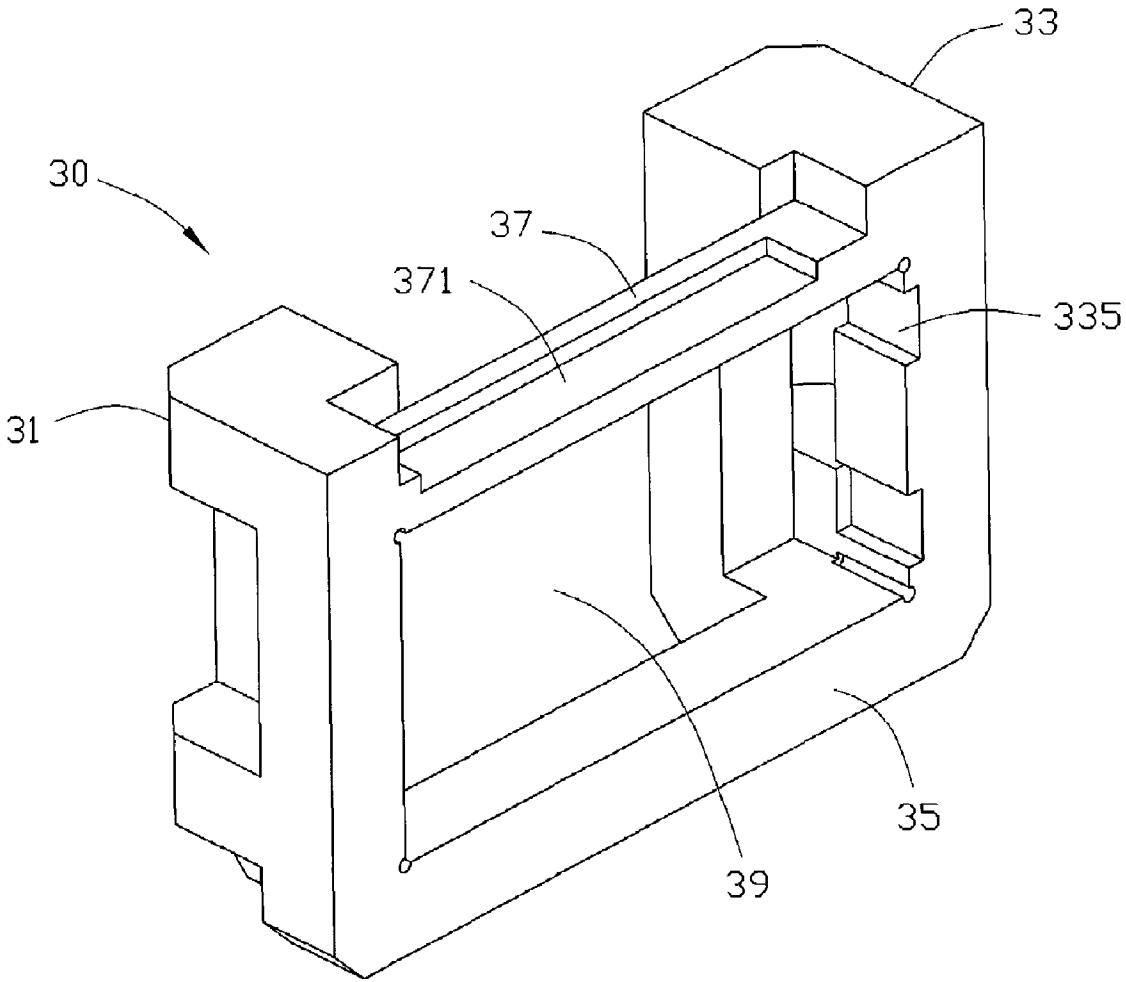
FIG. 2 is an isometric view of one of the first cushions in FIG. 1.

Referring also to FIG. 2, each of the first cushions 30 includes a substantially U-shaped foam frame substantially fitting the carton 10. The U-shaped frame includes a pair of opposite arms 31 and 33, and a cross-member 35 connected between the opposite arms 31 and 33 at the ends thereof. A cross-section view of each of the arms 31 and 33 reveals a substantially right-angled shape. Each of the arms 31 and 33 includes a first inner surface and a second inner surface perpendicular thereto. The first inner surfaces are opposite to each other. The second inner surfaces are coplanar. A support bar 37 is connected between the first inner surfaces. The U-shaped frame and the support bar 37 together define a rectangular window 39 for receiving one end portion of the computer 20. The second inner surfaces stop a further movement of the computer 20 along the first inner surfaces when the computer 20 is received in the window 39. A pair of spaced rectangular recesses 335 is defined in the first inner surfaces of the arm 33, for receiving two of the standoffs 21 of the computer 20. A narrow notch 371 is defined along the bar 37, for receiving and supporting the LCD 60.

Figure 3:
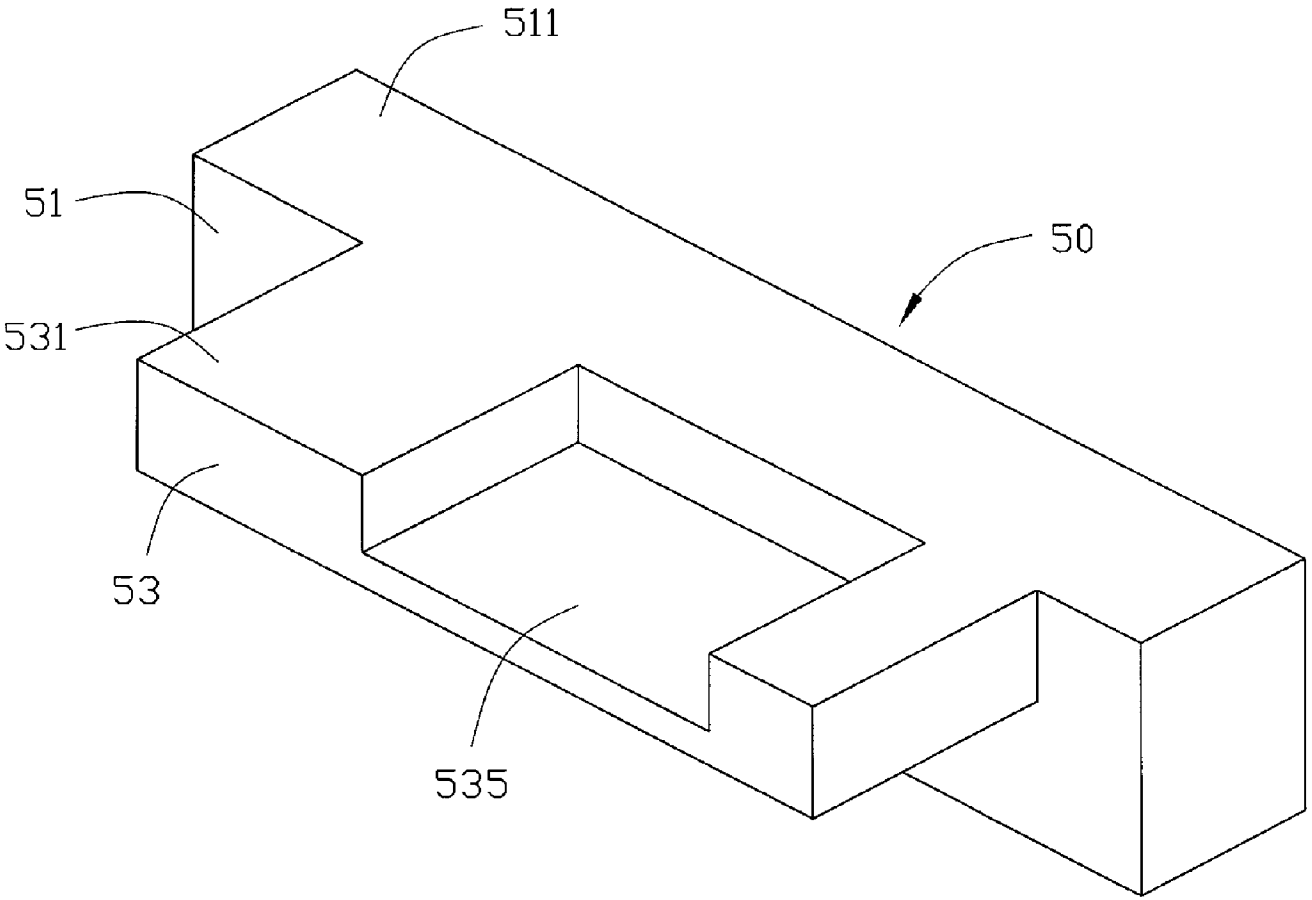
FIG. 3 is an isometric view of one of the second cushions in FIG. 1.

Referring also to FIG. 3, each second cushion 50 includes a rectangular base 51 having a bottom surface 511. A support board 53 extends along a centre portion of the bottom surface 511. The thickness of the support board 53 is less than that of the rectangular base 51. The support board 53 includes a top surface 533 (see FIG. 1), and a bottom surface 531 flush with the bottom surface 511. A recess 535 is defined in the bottom surface 531, for fitting one end portion of the rectangular board 63 of the LCD 60. The rectangular base 51 includes a side wall 513 perpendicular to the top surface 533 of the support board 53 (see FIG. 1). The first accessory box 70 is disposed between the side walls 513 of the pair of second cushion 50. A slot 515 is defined in the base 51 beside the side wall 513 and extending to the top surface 533 of the support board 53 (see FIG. 1). The second accessory box 80 is disposed on the support boards 53 of the second cushion 50 between the slots 515 thereof. Also, the pair of second cushions 50 can be formed as an integrated cushion.

Figure 4:
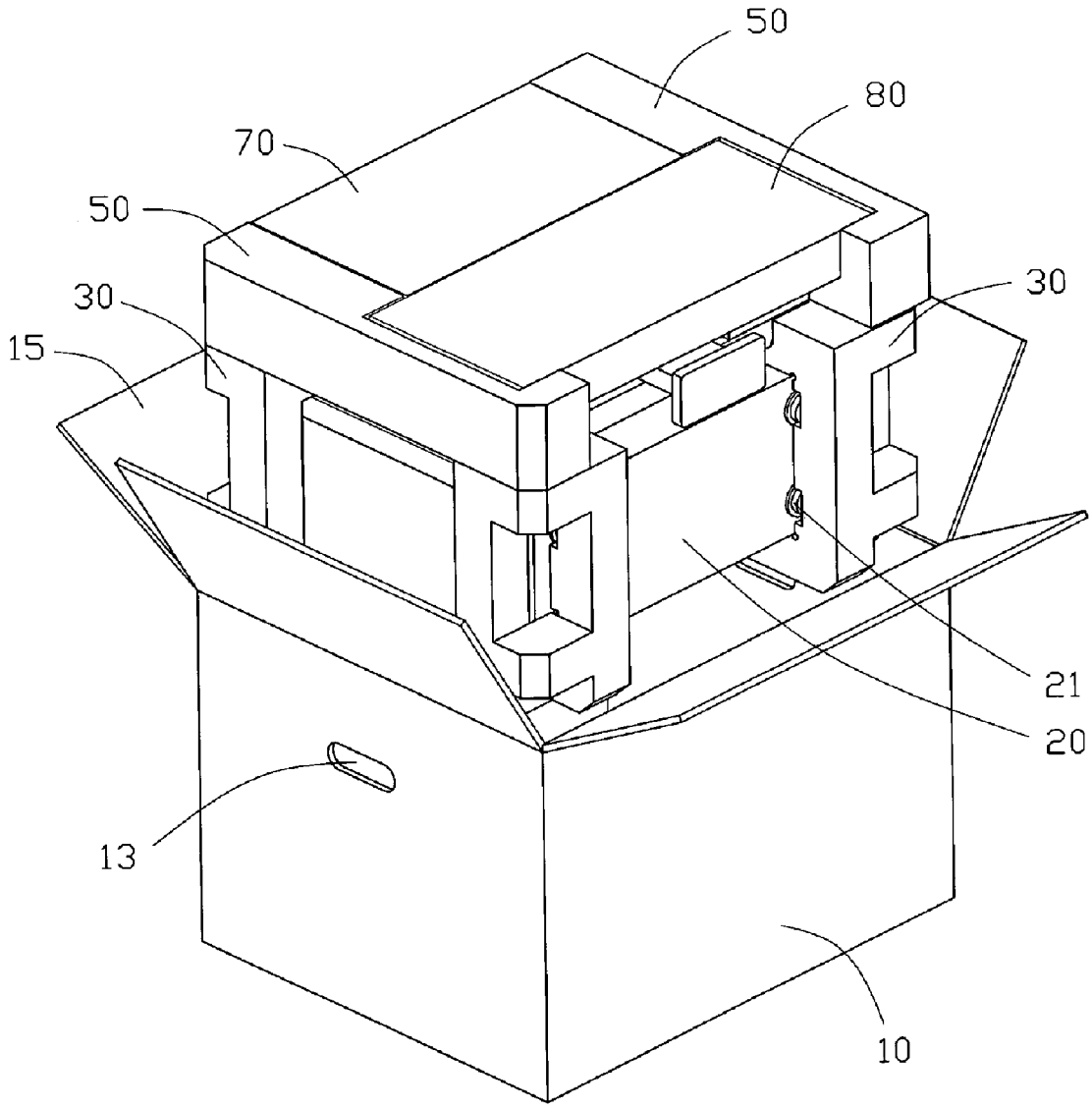
FIG. 4 is an isometric assembled view of FIG. 1.

Referring also to FIG. 4, in assembly, the computer 20 is disposed between the pair of first cushions 30 and received in the windows 39 thereof. The notches 371 of the first cushions 30 together form a receiving space. The flat screen 61 of the LCD 60 fits in the receiving space. Then, the pair of second cushions 50 is put on the pair of first cushions 30. The recesses 535 of the second cushions 50 fit on the rectangular board 63 of the LCD 60. The first accessory box 70 is disposed between the side walls 513 of the pair of second cushions 50. The second accessory box 80 is disposed between the slots 515 of the pair of second cushions 50. At last, the all-in-one packaging system is put in the housing 11 of the carton 10. The flaps 15 are closed. Then, the packaging process is finished.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An all-in-one packaging system, comprising:

a computer having four standoffs;

a liquid crystal display (LCD) comprising a screen and a board protruding from a back of the screen;

a pair of opposite first cushions, each cushion defining a window for receiving one end portion of the computer, a recess defined in a top edge of each cushion adjacent the window for receiving the screen of the LCD;

a pair of second cushions sitting atop each first cushion, each second cushion having a bottom surface with a shape configured to fit the back of the screen; and a carton defining a housing for receiving the assembled first and second cushions therein.

2. The all-in-one packaging system as described in claim 1, wherein each of the first cushions comprises a U-shaped frame having a pair of opposite arms, a support bar is connected between the arms adjacent to free ends of the arms, the frame and the support bar together define the window.

3. The all-in-one packaging system as described in claim 2, wherein the recess for receiving the screen of the LCD is defined in the support bar.

4. The all-in-one packaging system as described in claim 2, wherein a cross-section view of each arm of the U-shaped frame reveals a right-angled shape, and each arm comprises a first inner surface and a second inner surface perpendicular to each other.

5. The all-in-one packaging system as described in claim 4, wherein a pair of spaced recesses is defined in the first inner surface of one of the arms for receiving two of the standoffs of the computer.

6. The all-in-one packaging system as described in claim 1, wherein each of the second cushions comprises a rectangular base and a rectangular support board extending from a bottom edge of the base.

7. The all-in-one packaging system as described in claim 6, wherein the shape of each of the second cushions for fitting the board of the LCD is defined as a rectangular recess in a bottom surface of the support board.

8. The all-in-one packaging system as described in claim 6, wherein each of the bases of the second cushions having a side wall perpendicular to the support board, for sandwiching a first accessory box therebetween.

9. The all-in-one packaging system as described in claim 8, wherein a slot is defined in each base adjacent the side wall and extending to a top surface of the support board, for receiving a second accessory box therebetween.

10. A computer packaging assembly, comprising:

a computer with two pairs of standoffs formed on a bottom wall thereof;

a liquid crystal display (LCD) comprising a flat screen and a board protruding from a back of the flat screen;

a pair of opposite first cushions, each first cushion defining a window for receiving one end portion of the computer, a recess defined in a top edge of each of the first cushions adjacent the window for receiving the screen of the LCD;

a pair of second cushions sitting atop the first cushions respectively, each of the second cushions having a bottom surface with a shape fitting the back of the screen, and first and second accessory boxes disposed on the second cushions; and a carton defining a housing for receiving the assembled first and second cushions therein.

11. The computer packaging assembly as described in claim 10, wherein each of the first cushions comprises a U-shaped frame having a pair of opposite arms, a support bar is connected to the arms therebetween, the frame and the support bar together define the window.

12. The computer packaging assembly as described in claim 11, wherein the recess for receiving the screen of the computer is defined in the support bar.

13. The computer packaging assembly as described in claim 11, wherein a cross-section view of each arm of the U-shaped frame reveals right-angled shape, and each arm comprises a first inner surface and a second inner surface perpendicular thereto.

14. The computer packaging assembly as described in claim 13, wherein a pair of spaced recesses is defined in the first inner surface of one of the arms for adapting two of standoffs of the computer.

15. The computer packaging assembly as described in claim 10, wherein the shape of the second cushions fitting the board defined at the back of the LCD is defined as a rectangular recess in a bottom surface of the second cushions.

16. The computer packaging assembly as described in claim 10, wherein the second cushions comprising a pair of side walls for sandwiching the first accessory box therebetween.

17. The computer packaging assembly as described in claim 16, wherein a pair of slots is respectively defined in each of the second cushions adjacent the side wall, for receiving the second accessory box therebetween.

18. A computer packaging assembly, comprising:

a computer;

a pair of first cushions attached to opposite end portions of the computer respectively, each first cushion defining a window receiving one corresponding end portion of the computer with edges of the window contactingly enclosing the corresponding end portion, a recess being defined in a top edge of the window and spaced from the window;

a liquid crystal display comprising a flat screen, the screen supported on the first cushions with opposite edge portions thereof received in the recesses of the first cushions respectively;

a pair of second cushions sitting atop the first cushions respectively, each of the second cushions having a bottom surface with a shape fitting a back of the display opposing the screen;

accessory boxes disposed on the second cushion; and a carton defining a housing for receiving the assembled computer, display, accessory boxes, first and second cushions therein.

19. The assembly as claimed in claim 18, wherein each of the first cushions comprises a U-shaped frame having a pair of opposite arms with a cross-member connecting ends of the arms, and a support bar connected between the arms away from the cross-member, the arms, the cross-member, and the support bar together defining the window, the recess being defined at the support bar.

20. The assembly as claimed in claim 18, wherein each of the second cushions comprises a base, a side wall extending from the base in a first direction, a support board extending from the base in a second direction perpendicular to the first direction, the support board fitting the back of the display, the accessory boxes being supported on the support boards of the second cushions and sandwiched between the side walls.

* * * * *